United States Patent [19]

Bartholomew et al.

[11] Patent Number: 4,742,773

[45] Date of Patent: May 10, 1988

[54] BLASTING SIGNAL TRANSMISSION TUBE DELAY UNIT

[75] Inventors: Stephen W. Bartholomew, Granby, Conn.; Daniel C. Rontey, Lebanon, N.J.; William J. Necker, Collinsville; Craig F. Adams, Granby, both of Conn.

[73] Assignee: The Ensign-Bickford Company, Simsbury, Conn.

[21] Appl. No.: 914,785

[22] Filed: Oct. 3, 1986

[51] Int. Cl.[4] ..... C06C 5/04

[52] U.S. Cl. ..... 102/275.3; 102/275.4; 102/275.7; 102/275.12; 102/202.13

[58] Field of Search ..... 102/202.13, 275.3, 275.4, 102/275.5, 275.6, 275.7, 275.11, 275.12, 289

[56] References Cited

U.S. PATENT DOCUMENTS

| | | | |
|---|---|---|---|
| 2,707,438 | 5/1955 | Mann et al. | 102/27 |
| 2,736,263 | 2/1956 | Lewis et al. | 102/27 |
| 2,891,476 | 6/1959 | Forsyth | 102/27 |
| 3,306,201 | 2/1967 | Noddin | 102/27 |
| 3,320,884 | 5/1967 | Kowalick et al. | 102/27 |
| 3,343,487 | 9/1967 | Hare, Jr. et al. | 102/27 |
| 3,353,485 | 11/1967 | Miller et al. | 102/27 |
| 3,718,095 | 2/1973 | Munger et al. | 102/102 |
| 3,727,552 | 4/1973 | Zakheim | 102/27 R |

FOREIGN PATENT DOCUMENTS 731108 3/1953 United Kingdom .

*Primary Examiner*—Peter A. Nelson

*Attorney, Agent, or Firm*—Hayes & Reinsmith

[57] ABSTRACT

A transmission tube signal delay assembly comprising a delay element containing a shaped delay composition having a preselected combustion time from a first side of the delay element to a second side of the delay element; a first transition element adjacent to the delay element at the first side for transferring a transmission tube signal to the delay element; and a second transition element adjacent to the delay element at the second side for transferring a signal from the delay element to a transmission tube, each of the transition elements comprising a shaped transition composition. Also, a method for delaying a transmission tube signal delay unit having a housing with a plurality of openings for receiving portions of signal transmission tube having interior-exposing opening means for securing the signal transmission tubes in the housing openings; and the signal delay assembly mounted in the housing with each of the transition elements positioned between the delay element and one of the housing openings for transferring a signal between the delay element and each of the signal transmission tubes.

6 Claims, 1 Drawing Sheet

BLASTING SIGNAL TRANSMISSION TUBE DELAY UNIT

BACKGROUND OF THE INVENTION

This invention relates to a time delay assembly for blasting signal transmission tube.

In detonating a plurality of blasting charges it is often required that the timing of such detonations be controlled precisely. This is true, for example, in blasting quarries where sequential delays between charges must be controlled within milliseconds. In order to control such timing of charges, transmission lines are deployed from a central initiating point to send a signal to detonate the individual blasting charges. Normally, these lines consist of one or more main trunk lines connected to a plurality of down lines.

Timing of the detonating signal is normally accomplished by using preselected lengths of known signal velocity transmission lines, and by utilizing signal delay units where necessary.

The manner of connection of the signal transmission lines, for example, between a trunk of lines and a plurality of down lines, depends on the type of transmission line utilized. Conventional destructing combustible fuses and detonation cords may be connected by tying together the line ends. In some cases supplementary charges are utilized to assure that the signal is transmitted. A supplementary charge device is as disclosed in U.S. Pat. No. 4,481,884. Where additional delay time is required, a delay unit may be utilized, for example, as disclosed in U.S. Pat. No. 2,736,263.

Non-destructing transmission tubes may also be utilized to carry a detonating signal, for example, as disclosed in U.S. Pat. No. 3,590,739. The detonating signal transmission tube disclosed therein is sold under the trademark "Nonel" and is sometimes referred to as "shock tube". As used herein, there term "signal transmission tube" refers to any detonating or deflagrating signal transmission line comprising a flexible hollow tube which can carry a detonating or deflagrating signal along its interior, which signal does not destroy the tube. Such signal transmission tube may be any of the different available tubes, for example, shock tube having a detonating powder coated on the inner periphery of the tube, as disclosed in the aforementioned U.S. Pat. No. 3,590,739, transmission tube containing a combustible gas within the hollow tube, transmission tube containing a combustible substance carried on a line inside the tube, or a transmission tube having a deflagrating substance coated on the inside of the tube as disclosed in co-pending U.S. patent application Ser. No. 811,731 assigned to the assignee of the present application.

The term "signal" when used in connection with the aforementioned transmission tube is intended to refer to both the detonating shock wave or deflagrating flame front which is transmitted along the interior of the shock tube by combustion of the reactive substances contained therein.

Conventional delay elements have not been suitable for use with shock tube because of the low intensity of the incoming transmission tube signal and problems in creating an outgoing transmission tube signal.

The low transmission tube signal intensity also causes problems in connecting the tubes. Unless the transmission tube signal is carefully directed and controlled, it may dissipate as it passes from one tube to another and fail to initiate a signal in the second tube. In addition, the presence of contaminating elements such as water may cause the signal to dissipate. As a result, field connections of signal transmission tubes have heretofore been unsatisfactory.

It is therefore an object of the present invention to provide an improved signal delay unit for signal transmission tube.

It is another object of the present invention to provide a delay unit for signal transmission tube which has improved reliability.

It is a further object of the present invention to provide a delay unit for signal transmission tube which may be utilized in field installations under adverse environmental conditions.

Other objects will be in part obvious and in part pointed out in more detail hereinafter.

A better understanding of the objects, advantages, features, properties and relations of the invention will be obtained from the following description and accompanying drawings which set forth certain illustrative embodiments and are indicative of the various ways in which the principles of the invention are employed.

SUMMARY OF THE INVENTION

In one aspect, the present invention comprises a transmission tube signal delay assembly having a delay element containing a shaped delay composition having a preselected combustion time from a first side of the delay element to a second side of the delay element; a first transition element adjacent to the delay element at the first side for transferring a transmission tube signal to the delay element; and a second transition element adjacent to the delay element at the second side for transferring a signal from the delay element to a transmission tube, each of the transition elements comprising a shaped transition composition.

In another aspect, the present invention comprises a transmission tube signal delay unit having a housing with a plurality of openings for receiving portions of signal transmission tubes having interior-exposing openings; means for securing the signal transmission tubes in the housing openings; and the signal delay assembly mounted in the housing with each of the transition elements positioned between the delay element and of the housing openings for transferring a signal between the delay element and each of the signal transmission tubes.

In a further aspect, the present invention comprises a method for delaying a transmission tube signal by directing a first transmission tube signal at a first transition composition; igniting the first transition composition with the first transmission tube signal to combust the first transition composition; igniting a first portion of a delay composition with the combustion of the first transition composition, the delaying composition having a preselected combustion time from the first portion to a second portion; igniting a second transition composition with the combustion of said delay composition second portion after the preselected time to combust the second transition composition; and initiating a signal in a second transmission tube with the combustion of the second transition composition.

BRIEF DESCRIPTION OF THE DRAWING

The sole FIGURE is a longitudinal cross sectional view of a preferred embodiment of the blasting signal transmission tube delay unit of the present invention.

DETAILED DESCRIPTION OF THE INVENTION

Figure 1:
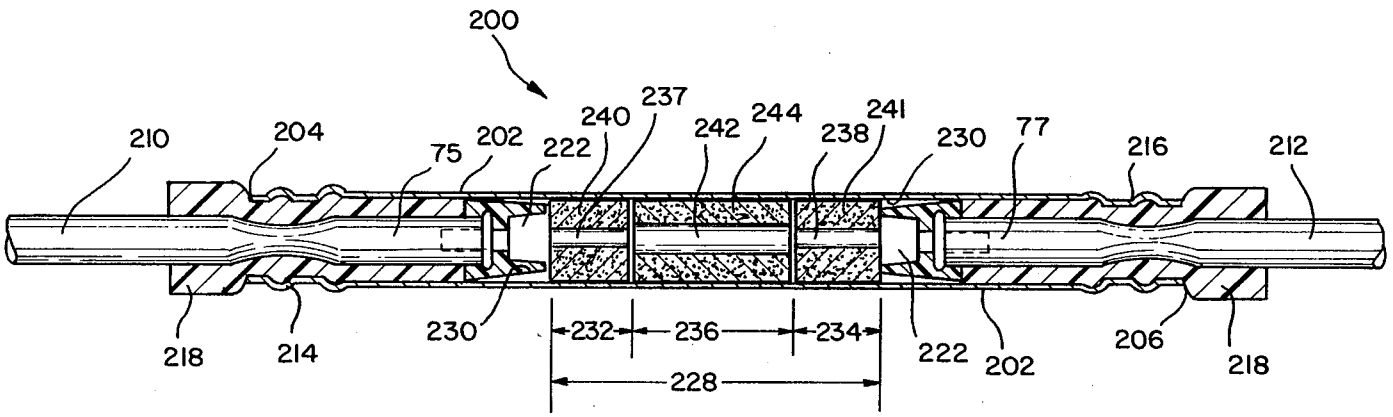

The nature of the transmission tube signal is such that, in practicing the present invention, attention must be paid to the positioning of the signal transmission tubes and delay assembly, the distance between the delay assembly and the transmission tube openings exposing the reactive interior portions, and the degree of enclosure about the path between the delay assembly and the signal transmission tube openings. In general, for signal communication to take place between a transmission tube and a delay assembly, the degree of enclosure necessary about the path between the delay assembly and the transmission tube openings is inversely proportional to the spacing therebetween i.e., a close spacing has less need for enclosure while a relatively large spacing requires a large degree of enclosure. Beyond a certain spacing, there can be no signal communication between signal transmission tubes and a signal delay assembly, regardless of the degree of enclosure.

Interior-exposing openings to a signal transmission tube may be made either by severing the tube completely to present a tube free end or by cutting away only a portion of the tube wall at some intermediate point between the tube ends. The size of the opening in the latter instance must be large enough to permit signal communication either into or out of the opening. The proper tube opening size for a particular application may be determined by simple experimentation.

The signal transmission tube is preferably secured in place in the delay unit of the present invention by means engaging the exterior of the tube, although auxilliary guide means may be employed which engage portions of the tube interior at the tube openings. The signal transmission tube securing means should be able to withstand the longitudinal forces created by the transmission tube signal entering or leaving the transmission tube opening, or applied in handling.

The preferred embodiment of the delay unit of the present invention is illustrated in the Figure in a longitudinal cross-sectional view. The delay unit 200 has a generally cylindrical shaped housing 202 with a hollow interior and a plurality of open ends 204, 206. The housing 202 should possess sufficient strength to resist internal detonating and deflagrating reaction forces, and longitudinal forces which may be applied in field use. The preferred material is aluminum tubing.

Signal transmission tubes 210, 212 are shown received in the open ends 204, 206, respectively, of the delay assembly housing 202. The transmission tube ends are secured firmly in the housing by crimping the housing near its ends 214, 216. This crimping action secures the housing against the signal transmission tube exterior to hold the tube in place without crushing or otherwise interfering with signal propagation within the signal transmission tube. An elastomeric material may be employed as a bushing 218 between the housing and signal transmission tube in the crimped region.

The interior of housing 202 forms channel 230 in which signal delay assembly 228 is disposed. The delay assembly 228 and channel 230 are both cylindrical in shape and are correspondingly configured to fit tightly together. The tight fit prevents direct transmission tube signal communication between opposing signal transmission tubes which would bypass the delay assembly. The delay assembly 228 comprises signal transition elements 232, 234 on either side of a delay element 236.

In approximately central location in the delay assembly 228 is a conventional delay element 236 containing a shaped delay composition 242 inside a lead tube 244. The delay composition may be of any known in the art, for example a mixture of silicon and lead dioxide ($PbO_2$); silicon and red lead oxide ($Pb_3O_4$); silicon, red lead oxide ($Pb_3O_4$) and antimony trisulfide ($Sb_2S_3$); tungsten, potassium perchlorate ($KC10_4$) and barium chromate ($BaCrO_4$); molybdenum and potassium perchlorate ($KC10_4$); and mixtures thereof.

The delay element functions to control combustion time from one side of the element to the other. This combustion time is preselected by the user and any range from nine (9) milliseconds to ten (10 seconds or longer, depending on the delay composition utilized.

On either side of the delay element 236 are signal transition elements 232, 234 containing a shaped transition composition 237, 238 packed inside a lead tube 240, 241. The transition elements 232, 234 are positioned directly adjacent to and abutting the delay element 236 to receive and transmit a blasting initiation signal between the severed signal transmission tube ends 75, 77 through the delay element.

An alignment cup 222 may be employed at each tube end 75, 77 to a direct the transmission tube signal between the transmission tubes and the transition elements.

The transition elements 232 or 234 function to transmit an incoming signal from a signal transmission tube to one side of the delay element. Once the signal has been transmitted through the delay element 236, the transition element 234 or 232 on the opposite side of delay element 236 transmits the signal to another transmission tube. Thus, the transition element has a dual input/output function and the combination connector and delay assembly, as illustrated, may be bidirectional.

The transition element utilized in the delay assembly and method of the present invention contains a shaped, finely granulated transition composition. As used herein, the term "transition composition" refers to a mixture of oxidizing and reducing agents which exothermically react to produce sufficient heat energy to ignite a signal in a signal transmission tube, and which may also be ignited by a signal from a signal transmission tube to react exothermally. The aforedescribed delay compositions will not function as a transition composition. Suitable transition compositions include a mixture of zirconium and potassium perchlorate ($KC10_4$), a mixture of titanium and potassium perchlorate ($KC10_4$), a mixture of boron and red lead oxide ($Pb_3O_4$), a mixture of zirconium and iron (III) oxide ($Fe_2O_3$), a mixture of zirconium and potassium chlorate ($KC10^3$), a mixture of zirconium and lead chromate ($PbCrO_4$), a mixture of titanium and lead chromate ($PbCrO_4$), a mixture of magnesium and barium chromate ($BaCrO_4$), a mixture of boron and potassium nitrate ($KNO_3$), and mixtures thereof. The transition composition components are first finely pulverized by conventional means, admixed and then shaped, for example, by pressing to a desired form. The mixed transition composition is optionally mixed with a binder, for example, a polyester resin, before shaping. Preferably the mixed transition composition is packed in a metal tube, for example, lead, which is then drawn down to a smaller diameter. The transition element may then be made by cutting lengths of the transition composition-containing tube.

The transition composition 237 in transition element 232 may be the same as or may be different from the transition composition 238 in transition element 234.

Since the purpose of the delay assembly is to delay signal propagation between the signal transmission tubes connected thereto, the delay element and transition elements must be fitted into the housing to prevent signal bypassing.

In normal operation, an incoming signal will be transmitted from a signal transmission tube to a first transition element in the form of a pulsed shock wave or a flame front. The incoming signal initiates combustion of a first transition composition. Combustion of the first transition composition from the transmission tube side to the delay element side occurs preferably in less than about 35 milliseconds. The combustion of the transition composition then ignites the first side of the delay element. The delay element delaying composition will effect combustion from one side of the element to another side in a preselected time ranging typically up to ten (10) seconds, depending on the particular delay element and composition employed. At the end of the preselected delay element combustion time, a second transition element will be ignited. Combustion of the second transition element will then initiate a signal in an outgoing signal transmission tube and cause that signal to be propogated therein in a direction away from the delay element.

Since the present invention will be primarily employed outdoors, bushings 218 provide an environmental seal for the delay unit. This environmental seal restricts infiltration of water and other contaminants into the region surrounding the delay assembly 228 and tube ends 75, 76. Such contaminants, if allowed into the unit may interfere with signal communication between the signal transmission tubes and delay assembly.

While this invention has been described with reference to specific embodiments, it will be recognized by those skilled in the art that variations are possible without departing from the spirit and scope of the invention, and that it is intended to cover all changes and modifications of the invention disclosed herein for purposes of illustration which do not constitute departure from the spirit and scope of the invention.

Having thus described the invention, what is claimed is:

1. A transmission tube signal delay assembly comprising:

a delay element containing a delay composition having a preselected combustion time from a first side of said delay element to a second side of said delay element;

a first transition element abutting said delay element at said first side for transferring a transmission tube signal to said delay element;

a second transition element abutting said delay element at said second side for transferring a signal from said delay element to a transmission tube, each of said transition elements, and said delay element being enclosed in a housing having end openings opposite the first and second transition elements and a length of transmission tube secured in each end opening.

2. The assembly of claim 1 wherein the transition composition is selected from the group consisting of a mixture of zirconium and potassium perchlorate, a mixture of titanium and potassium perchlorate, a mixture of boron and red lead oxide, a mixture of zirconium and iron oxide, a mixture of zirconium and potassium chlorate, a mixture of zirconium and lead chromate, a mixture of titanium and lead chromate, a mixture of magnesium and barium chromate, a mixture of boron and potassium nitrate, and mixtures thereof.

3. The unit of claim 1 wherein said securing means comprises a crimpable bushing at each of said housing openings for securing said housing to the exterior of said signal transmission tube.

4. The unit of claim 1 additionally comprising means for aligning said transmission tube interior-exposing openings with said transition elements.

5. The unit of claim 4 wherein said alignment means comprises a sleeve insertable in the opening of said signal transmission tube.

6. The unit of claim 3 wherein said bushings provide an environmental seal between said housing and said transmission tubes.

* * * * *